United States Patent [19]

Eisenbach et al.

[11] Patent Number: 4,815,222

[45] Date of Patent: Mar. 28, 1989

[54] CLEATED CYCLING SHOE WITH SUPPORT STRAPS

[75] Inventors: Lawrence P. Eisenbach; Thomas P. Allen, III, both of Beaverton, Oreg.

[73] Assignee: Nike, Inc., Beaverton, Oreg.

[21] Appl. No.: 1,761

[22] Filed: Jan. 9, 1987

[51] Int. Cl.[4] ..... A43B 5/14; A43C 11/00

[52] U.S. Cl. ..... 36/131; 36/50; 36/58.5; 74/594.6

[58] Field of Search ..... 36/62, 131, 50, 58.5, 36/114, 115, 129; 74/594.6, 594.4

[56] References Cited

U.S. PATENT DOCUMENTS

| | | | |
|---|---|---|---|
| 252,715 | 1/1882 | Bass | 36/50 |
| 2,658,289 | 11/1953 | Schrieber . | |
| 3,707,047 | 12/1972 | Nedwick . | |
| 3,769,722 | 11/1973 | Rhee . | |
| 4,308,672 | 1/1982 | Antonious | 36/50 |
| 4,361,972 | 12/1982 | Miller . | |
| 4,458,431 | 7/1984 | Sinclair | 36/50 X |
| 4,476,639 | 10/1984 | Zaccaria . | |
| 4,535,554 | 8/1985 | De Obladia . | |
| 4,538,480 | 9/1985 | Trindle . | |

FOREIGN PATENT DOCUMENTS

| | | | |
|---|---|---|---|
| 244801 | 1/1966 | Austria | 36/58.5 |
| 0061971 | 10/1982 | European Pat. Off. | 36/114 |
| 374469 | 4/1923 | Fed. Rep. of Germany | 36/128 |
| 3135345 | 3/1983 | Fed. Rep. of Germany | 36/131 |
| 3414971 | 10/1985 | Fed. Rep. of Germany . | |
| 2397319 | 2/1979 | France | 36/131 |
| 2555417 | 5/1985 | France | 36/131 |
| 289051 | 6/1953 | Switzerland | 36/129 |
| 2058690 | 4/1981 | United Kingdom | 74/594.6 |

OTHER PUBLICATIONS

P. 27 of "The Runner" magazine (Apr. 1986 Edition).
P. 5 of "The Runner" magazine (Aug. 1986 Edition).

*Primary Examiner*—James Kee Chi
*Attorney, Agent, or Firm*—Banner, Birch, McKie & Beckett

[57] ABSTRACT

An improved cleated cycling shoe is disclosed. The cleated cycling shoe of the present invention is intended to improve performance and eliminate the problems associated with traditional cycling shoes when used with quick release binding systems. The shoe may also be used with traditional toe strap/cleat binding systems. The shoe comprises an upper, a rigid outsole plate fixed to the upper, and two support straps fixed at one end to the upper, having their free end drawn around the upper through a loop integrally formed on the outsole plate and back across the upper where they are fastened by means such as a hook and loop fastener. The support straps further reduce play of the foot within the shoe, provide additional support for the foot, and prevent the upper from being pulled apart from outsole plate due to extreme upstroke forces.

21 Claims, 4 Drawing Sheets

1
2
3
4
5
6

CLEATED CYCLING SHOE WITH SUPPORT STRAPS

TECHNICAL FIELD

The present invention relates to a cleated bicycle shoe. More particularly, the present invention relates to an improved cleated bicycle shoe having support straps for improved performance.

BACKGROUND OF THE INVENTION

When pedaling a bicycle in a normal manner with the rider's shoes not attached to the pedals, the pedaling force to route the bicycle drive wheel is only provided during about half the 360° of movement of each pedal. That is, first one pedal is providing the basically downwardly thrust to rotate the pedal sprocket while the other pedal is moving upwardly without any driving force being provided, then the situation is reversed as the other pedal is moved downwardly. These alternating forces by the opposite pedals are satisfactory for much bicycling activity. However, it is well known that it is much more efficient to propel a bicycle if each pedal is providing thrust throughout the entire 360° of rotation for each of the pedals.

Bicycle racers as well as recreational bicyclists attach their shoes to the pedals to enable the application of force throughout the entire 360° rotation. There are two main methods for attaching the shoes to the pedals. The most common approach is to use a toe clip and strap which cups the toe of the shoe and straps it to the pedal. Often a cleat is also used to prevent the shoe from sliding rearwardly out of the toe clip. A newer connecting arrangement incorporates a quick release type of tab and groove or cleat and pedal system. In this system the bottom portion of the shoe contains either tabs or grooves which mate with corresponding grooves or tabs, respectively, mounted on the bicycle pedal. This system allows for quick secure attachment to a pedal without the encumbrance of the traditional toe clip/toe strap/cleat system which requires loosening the toe clip strap for pedal entry and tightening the strap for a secure fit and optimum pedaling efficiency. With the quick release binding system the rider merely twists or slides his or her foot in or out of the pedal for secure fastening without the use of a toe clip.

However, using the quick release cleat and pedal binding system with traditional cleated cycling shoes has several drawbacks. Often the foot becomes unsupported and moves away from the outsole within the upper on the upstroke phase of pedaling such as in hill climbing situations. Other situations, such as competitive racing, also result in upstroke forces which are sufficient to pull the foot off of the shoes' innersole board, causing excessive movement of the foot within the shoe. This decreases pedaling efficiency. In other instances, the forces applied during the upstroke can be great enough to pull the upper of the shoe apart from the outsole plate altogether.

One prior art bicycle shoe uses a single support strap wrapped around the entire shoe through a slot formed in the outsole. While threading the strap through the slot apparently avoids interference between the strap and the cleat, it results in an outsole that is thicker, bigger, and probably heavier. The outsole must be enlarged to accommodate the slot. Also, such single support straps are apparently located across the middle of the metatarsal bones. However, this location does not include the point of greatest force, the first metatarsal head. Thus, it cannot absorb and transmit to the sole the greatest percentage of the force. Moreover, straps at such a location would constrict the foot, interfere with the foot's natural flexion, and irritate the foot.

SUMMARY OF THE INVENTION

It is an object of the present invention to provide an improved cleated cycling shoe in which the upper/outsole connection is reinforced and movement of the foot within the shoe is reduced.

It is another object of the present invention to provide an improved cleated cycling shoe that is lightweight, compact and has a thin outsole.

A cleated cycling shoe according to the present invention includes a shoe upper and an outsole plate which is permanently fixed to the upper. The outsole plate is preferrably rigid to prevent heel collapse while still permitting the foot to flex sufficiently at the metatarsal heads. The outsole plate has two loops, a forefoot loop and a midfoot loop rigidly connected to and preferrably formed integrally with the outsole plate. The loops are located on the medial side of the outsole plate. Cleats for detachably mounting the cycling shoe on a bicycle pedal are detachably mounted on the outsole plate by fastening means disposed on the outsole plate. The upper also includes means for securing the upper around the foot of a wearer, such as ordinary shoe laces. The cycling shoe also includes two support straps which transmit forces from the upper of the shoe to the outsole plate, which provide additional foot support and prevent the foot from moving within the shoe, and which prevent the upper of the shoe from being pulled apart from the outsole plate of the shoe during the upstroke phase of pedaling. One of the straps is a forefoot support strap and the other is a midfoot support strap. Both straps are fixed at a first end to the shoe upper at its lateral side. The second end of the support straps is freely drawn across the upper of the shoe, threaded through the loop, and drawn back across the upper of the shoe where it is fastened at the first end of the support straps. Various fastening means such as hook and loop fasteners may be used. The use of the midfoot support strap enables the shoe to be used without other securing means such as laces.

Forces applied to the shoe upper during the upstroke phase of pedaling using a quick release binding system are indirectly transmitted through the support straps to the outsole plate. This transmission of forces from the upper to the outsole plate prevents the foot from becoming unsecured within the shoe and relieves any tendency of the upper to pull apart from the outsole plate by providing the support required during the upstroke phase of pedaling.

The forefoot strap is preferrably attached to the upper on the lateral side of the upper and passes through a forefoot loop located on the medial side of the outsole plate. The forefoot strap passes generally across but slightly behind the line of metatarsal heads. This includes passing slightly behind the first metatarsal head, the point where the upstroke forces exerted on the foot and on the shoe are greatest. The forefoot strap's primary function is to transmit these upstroke forces to the outsole which transmits the forces to the pedal. The midfoot strap, which is located rearward of the forefoot strap, aids in this function but primarily aids in securing the shoe about the foot.

This dual strap method, wherein the forefoot strap is precisely located to pass just behind the first metatarsal head, and thereafter follows a line directly behind the remaining metatarsal heads, is superior to prior art methods. The two strap design of the present invention is superior because of the added advantages of the midfoot strap in securing closure of the shoe about the foot, and because of the aforementioned disadvantages in placement of a single strap. Two straps allows one to be used to aid closure, and another to best secure the upper to the outsole. Also, the cleated cycling shoe of the present invention has a sole of minimal weight, bulk, and thickness.

The cleated cycling shoe of the present invention allows for optimal support of the foot by the shoe upper while using cleat/pedal systems such as quick release binding systems which do not use a toe clip. In addition, the cleated cycling shoe of the present invention does not have its performance compromised when the conventional toe clip system is used.

Various additional advantages and features of novelty which characterize the invention are further pointed out in the claims that follow. However, for a better understanding of the invention and its advantages, reference should be made to the accompanying drawings and descriptive matter which illustrate and describe a preferred embodiment of the invention.

DETAILED DESCRIPTION OF THE PREFERRED EMBODIMENT

Figures 1, 2:
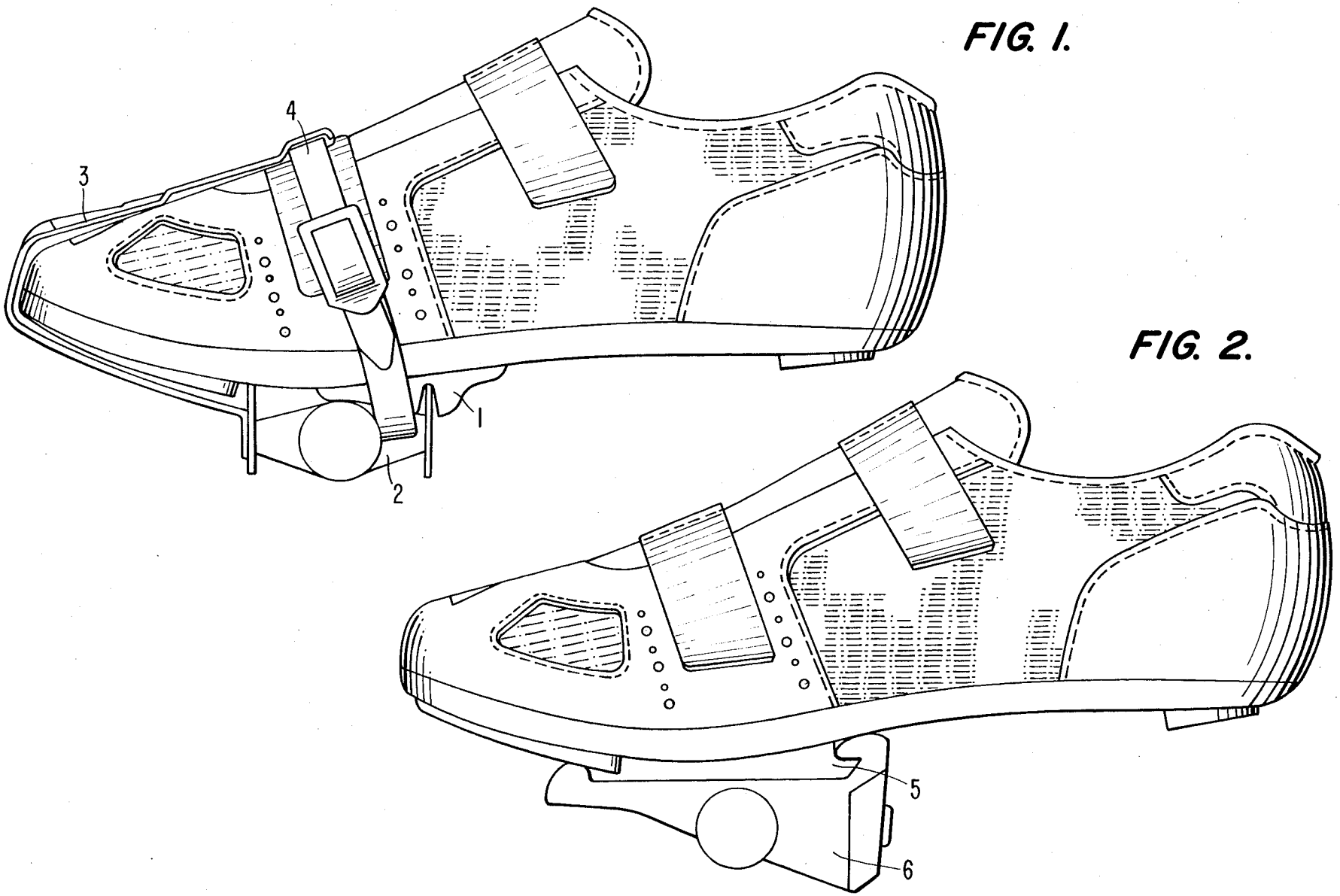
FIG. 1 is a lateral side view of a cleated cycling shoe according to the present invention mounted in a traditional toe clip pedal binding.
FIG. 2 is a lateral side view of the cleated cycling shoe according to the present invention mounted in a quick release pedal binding.
Figure 3:
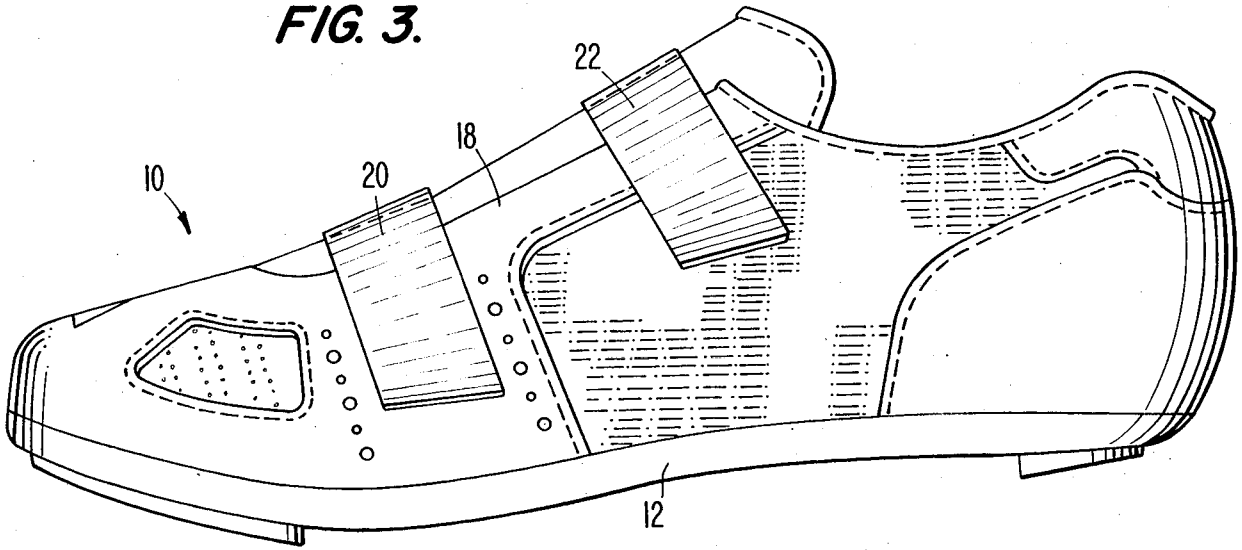
FIG. 3 is a side view of the cleated cycling shoe according to the present invention showing the lateral side of the shoe.

FIGS. 1 and 2 show the two methods for retaining a cycling shoe in contact with a bicycle pedal. The more traditional method shown in FIG. 1 uses a cleat 1 which matingly fits on a portion of a pedal 2 in combination with a toe clip 3 and an adjustable toe strap 4. This system requires loosening toe strap 4 for pedal entry, and tightening toe strap 4 for a secure fit and optimum pedaling efficiency. A quick release system shown in FIG. 2 includes quick release cleat 5 which matingly fits onto a corresponding pedal 6. With this system the rider merely twists his or her foot in or out of pedal 6 for secure fastening. No toe clip nor any toe strap is required. However, when the quick release binding system is used with traditional cleated cycling shoes, the upstroke pedaling force sometimes causes excessive movement of the foot within the shoe and in extreme cases pulls the upper apart from the outsole plate of the shoe. The present invention addresses and solves this lack of support problem. The cycling shoe of the present invention may be used with the new quick release bindings as well as the more traditional bindings using toe clips and toe straps.

Figure 4:
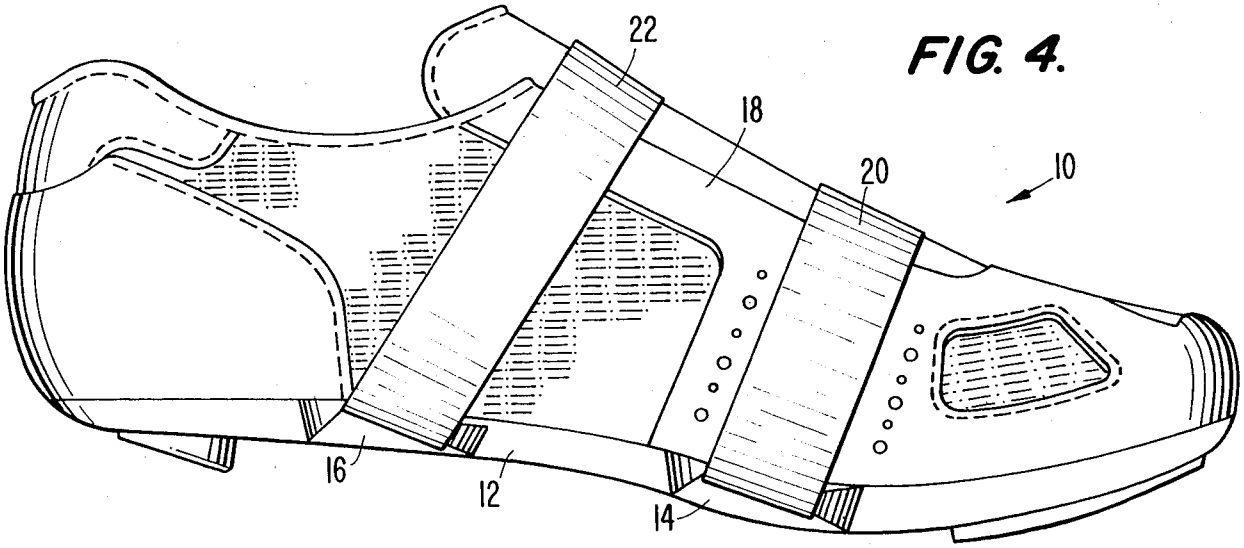
FIG. 4 is a side view of the cleated cycling shoe according to the present invention showing the medial side of the shoe.
Figure 5A:
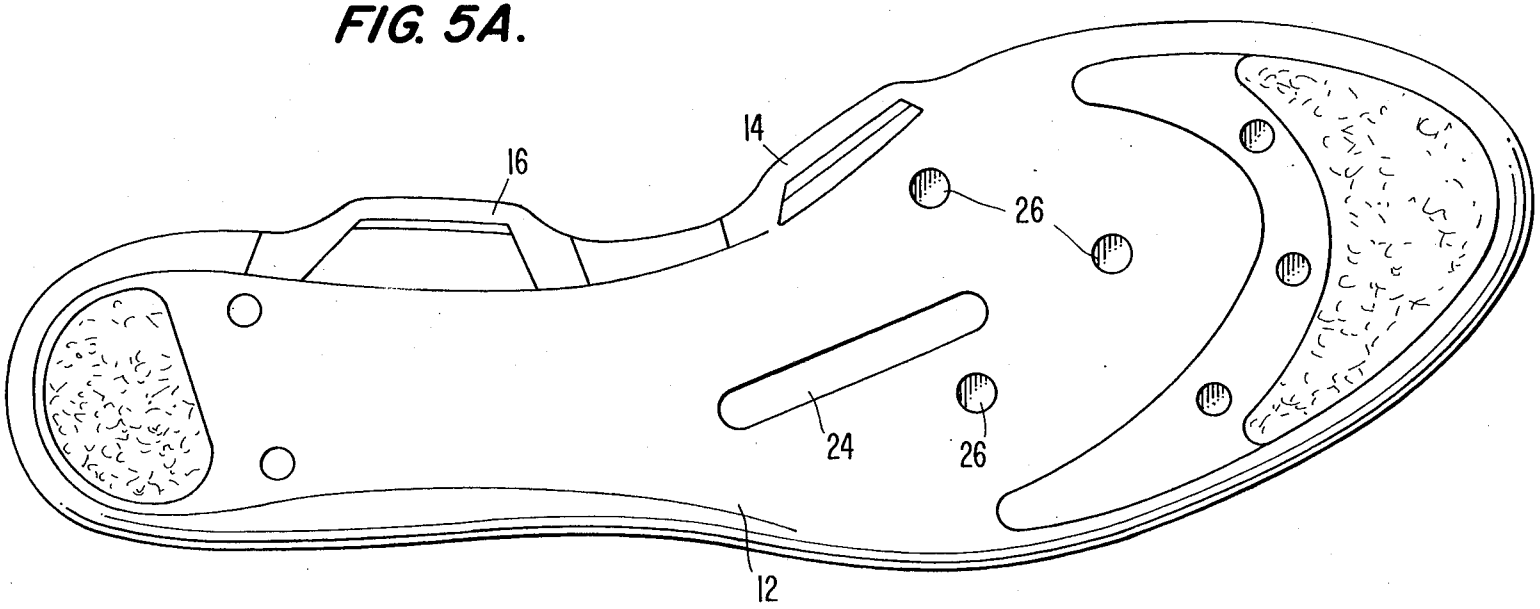
FIG. 5A is a bottom view of the outsole plate of the cleated cycling shoe according to the present invention.
Figure 5C:
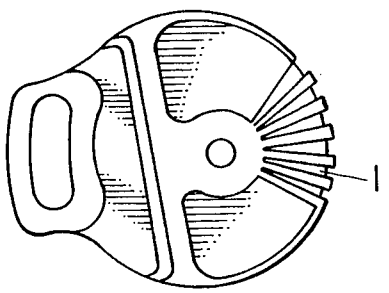
Figure 5C is a bottom view of one type of traditional pedal binding cleat.
Figure 5B:
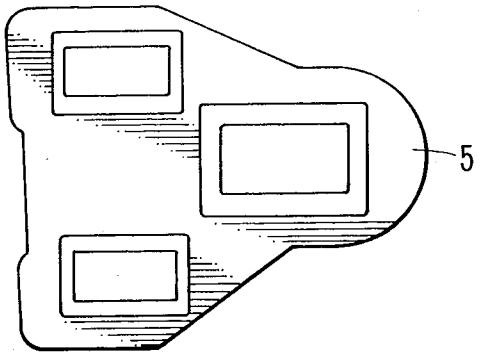
FIG. 5B is a bottom view of one type of quick release pedal binding cleat.
Figure 6:
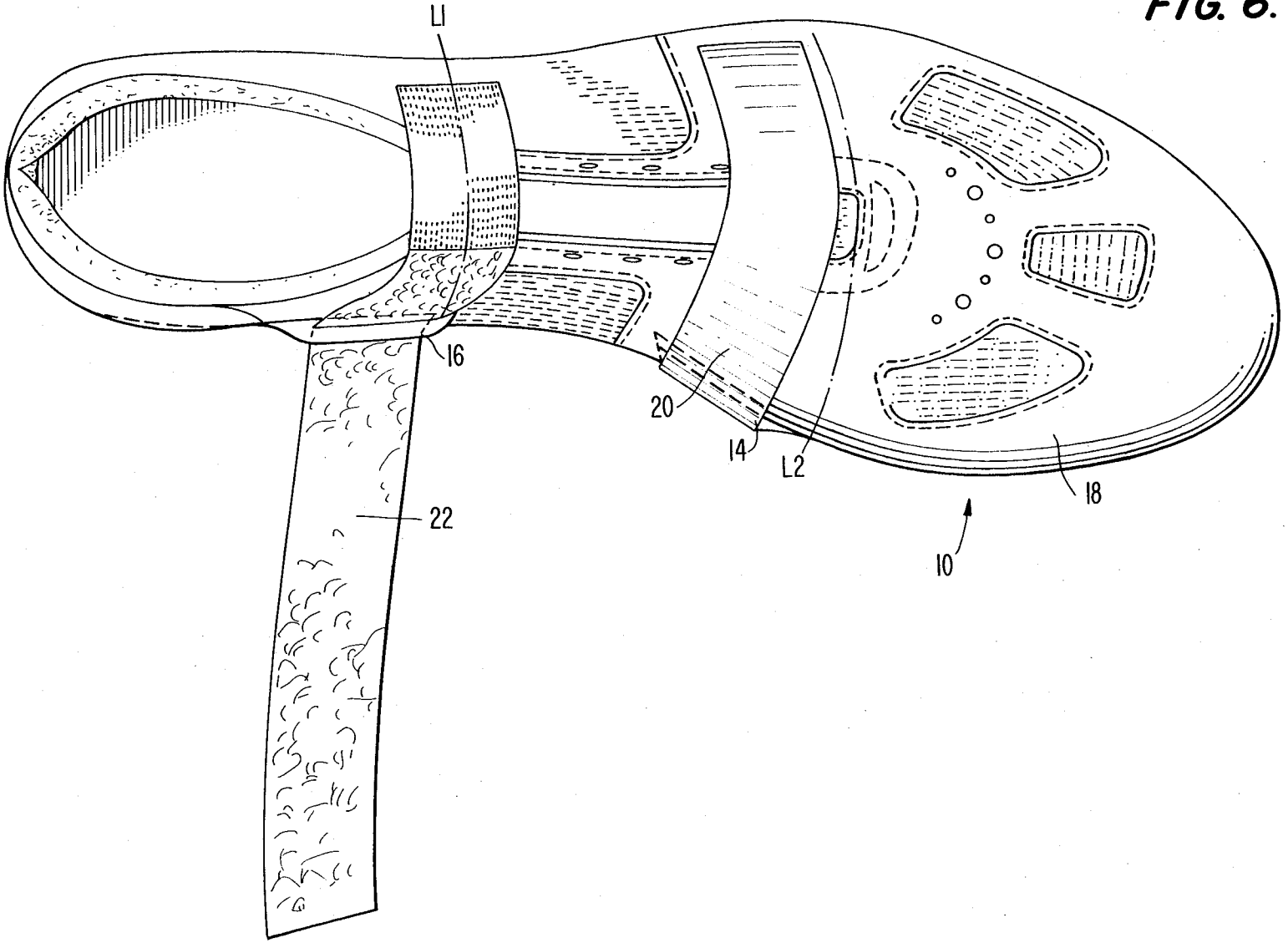
FIG. 6 is a top view of the cleated cycling shoe according to the present invention.

Referring to FIGS. 3 through 6 the cleated cycling shoe of the present invention is shown. The cleated cycling shoe 10 comprises a preferrably rigid outsole plate 12 which extends along the entire length of shoe 10. The outsole plate need not be rigid, particularly if the shoe is not a racing shoe. Outsole plate 12 has a forefoot loop 14 and midfoot loop 16 integrally formed therewith on the medial side. As shown in FIG. 5 a cleat mounting groove 24 is formed in rigid outsole plate 12 to facilitate mounting of cleats 1 for use with a toe clip binding system. Cleat mounting holes 26 are formed in rigid outsole plate 12 to facilitate mounting quick release cleat 5 of the quick release binding system. Mounting may be accomplished by any suitable means such as screws (not shown). The use of screws within cleat mounting groove 24 permits cleat 1 to be adjustably mounted in any one of a number of positions on the cleated cycling shoe.

The cleated cycling shoe also comprises an upper 18 fastened to rigid outsole plate 12 in a conventional manner such as with an adhesive. A forefoot support stap 20 and a midfoot support strap 22 each have a fixed end attached to the lateral side of upper 18. The support straps are drawn across the top of upper 18 through their respective loops 14, 16 and back over upper 18 of shoe 10 where free ends of the straps are fastened to the fixed ends by any suitable means such as a hook and loop fastener. The bulk and thickness of the support straps are kept to a minimum so that when the shoes are used with traditional toe clip systems sufficient clearance is maintained to allow ease of entry and exit of the shoe into the toe clip and straps. The thickness of the straps can be kept small by using an unlined and unbacked hook and loop closure material. Additionally, threading the straps through the loops of the outsole plate allows the wearer to further tailor the fit of the upper around the foot by tightening or loosening the position of the support straps on the lateral side of the shoe.

The support straps are stratigically positioned on the upper to provide the upper with support where support is most critically required. The midfoot strap primarily ensures that the foot is securely helded within the upper; it prevents the foot from pulling out of the shoe during acceleration and improves the fit of the shoe when used with all pedal binding types. Secondarily, it aids the forefoot strap in transmitting forces applied to the upper in the upstroke phase of pedaling to the outsole plate. The midfoot strap is located across the top of the instep of the foot, across the connection between the metatarsals and the tarsus bones (ankle bones). This connection is located generally as shown by Line L1 in FIG. 6. Such a location does not impede flexion of the foot nor abrade the foot.

The primary function of the forefoot strap is to prevent movement of the foot within the upper and to prevent the upper from pulling apart from the outsole. The forefoot strap is located along the line of metatarsal heads. The line of metataral heads is located generally as shown by Line L2 in FIG. 6. This is directly above the location of a quick release binding cleat and covers the point where the forces on the foot and on the shoe caused by the quick release cleat and pedal connection are the greatest. This point of greatest force is adjacent to and slightly behind the first metatarsal head; i.e., the ball of the foot. The forefoot strap is not located directly on the first metatarsal head as there it would impair flexion of the foot and would abrade the foot; it is located immediately behind the first metatarsal head and extends generally along the line of the metatarsal heads, but likewise slightly behind the respective metatarsal heads. The forefoot strap transmits the forces from the upper to the outsole plate where the forces are transmitted to the pedal. The forefoot loop is located on the medial side of the outsole, almost directly behind and to the side of the first metatarsal head. Because along the line of metatarsal heads forces are greatest behind the first metatarsal head (behind the big toe), the connection of the forefoot strap to the outsole plate is at the optimal location for the forefoot loop to most efficiently transmit the upstroke forces to the pedal through the outsole plate.

The loops integrally molded on the outsole plate are positioned fore and aft to coincide with the support straps located on the upper and to retain clearance between the shoe and pedal crankarms of the bicycle. As shown in FIG. 4, forefoot loop 14 and midfoot loop 16 are preferrably angled downwardly toward the front of the shoe. This allows the straps to lay flat against the upper and prevents the straps from buckling when under tension. Additionally, the outsole plate and integral loops are formed of a suitable material and in a suitable configuration that resists fracture under severe load conditions such as in competitive bicycle racing. For example, the outsole plate can be formed of a reinforced nylon composition.

Numerous characteristics and advantages of the invention have been described in detail in the foregoing description with reference to the accompanying drawings. However, the disclosure is illustrative only and the invention is not limited to the precise illustrated embodiment. Various changes and modifications may be affected therein by one skilled in the art without departing from the scope or spirit of the invention.

We claim:

1. A cleated cycling shoe comprising:

an upper;

an outsole plate permanently fixed to said upper;

means for detachably mounting and locating on said outsole plate cleats for detachably mounting said shoe on a bicycle pedal;

a forefoot support strap attached to said shoe, connected to said outsole plate and overlapping said upper for transmitting forces from said upper to said outsole plate and for providing additional foot support and preventing said upper from pulling away from said outsole plate during upstroke pedaling motion; and a midfoot support strap attached to said shoe, connected to said outsole plate and overlapping said upper for transmitting forces from said upper to said outsole plate and for providing additional foot support and preventing said upper from pulling away from said outsole plate during upstroke pedaling motion.

2. A cleated cycling shoe comprising:

an upper;

an outsole plate permanently fixed to said upper;

means for detachably mounting and locating on said outsole plate cleats for detachably mounting said shoe on a bicycle pedal;

a forefoot support strap attached to said shoe and extending generally along and behind the line of metatarsal heads so that the natural flexing of the foot is not inhibited by the forefoot strap, connected to said outsole plate, and overlapping said upper for transmitting forces from said upper to said outsole plate and for providing additional foot support and preventing said upper from pulling away from said outsole plate during upstroke pedaling motion; and a midfoot support strap attached to said shoe, connected to said outsole plate, and overlapping said upper for transmitting forces from said upper to said outsole plate and for providing additional foot support and preventing said upper from pulling away from said outsole plate during upstroke pedaling motion.

3. A cleated cycling shoe as set forth in claim 1 or 2 wherein said outsole plate is rigid.

4. A cleated cycling shoe as set forth in claims 1 or 2 further comprising cleats removably attached to said outsole plate.

5. A cleated cycling shoe as set forth in claims 1 or 2 further comprising means for securing said upper around the foot of a wearer.

6. A cleated cycling shoe as set forth in claim 2 wherein said midfoot support strap extends generally across the instep of the foot.

7. A cleated cycling shoe comprising:

an upper;

an outsole plate permanently fixed to said upper, said outsole plate comprising a forefoot loop and a midfoot loop rigidly connected to said outsole plate;

means for detachably mounting and locating on said outsole plate cleats for detachably mounting said shoe on a bicycle pedal;

a forefoot support strap atatched to said shoe, connected to said outsole plate and overlapping said upper for transmitting forces from said upper to said outsole plate and for providing additional foot support and preventing said upper from pulling away from said outsole plate during upstroke pedaling motion, said forefoot support strap being fixed at a first end of said upper on the side of said shoe opposite said forefoot loop, and having a second end freely drawn across said upper, through said forefoot loop, and back across itself, said forefoot support strap being adjustably fastened to said first end of said forefoot support strap; and a midfoot support strap attached to said shoe, connected to said outsole plate and overlapping said upper for transmitting forces from said upper to said outsole plate and for providing additional foot support and preventing said upper from pulling away from said outsole plate during upstroke pedaling motion, said midfoot support strap being fixed at a first end to said upper on the side of said shoe opposite said midfoot loop and having a second end freely drawn across said upper, through said midfoot loop, and back across itself, said second end of said midfoot support strap being adjustably fastened to said first end of said midfoot support strap.

8. A cleated cycling comprising:

an upper;

an outsole plate permanently fixed to said upper, said outsole plate comprising a forefoot loop and a midfoot loop rigidly connected to said outsole plate;

means for detachably mounting and locating on said outsole plate cleats for detachably mounting said shoe on a bicycle pedal;

a forefoot support strap attached to said shoe, connected to said outsole plate and overlapping said upper for transmitting forces from said upper to said outsole plate and for providing additional foot support and preventing said upper from pulling away from said outsole plate during upstroke pedaling motion, said forefoot support strap extending across said upper from a side of said shoe opposite said forefoot loop, through said forefoot loop, and back across itself, said forefoot support strap being adjustably fastenable and; and a midfoot support strap attached to said shoe, connected to said outsole plate and overlapping said upper for transmitting forces from said upper to said outsole plate and for providing additional foot support and preventing said upper from pulling away from said outsole plate during upstroke pedaling motion, said midfoot support strap extending across said upper from a side of said shoe opposite said midfoot loop, through said midfoot loop, and back across itself , said midfoot support strap being adjustably fastenable.

9. A cleated cycling shoe comprising:

an upper;

an outsole plate permanently fixed to said upper, said outsole plate comprising a forefoot loop and a midfoot loop rigidly connected to said outsole plate;

means for detachably mounting and locating on said outsole plate cleats for detachably mounting said shoe on a bicycle pedal;

a forefoot support strap attached to said shoe and extending generally along and behind the line of metatarsal heads so that the natural flexing of the foot is not inhibited by said forefoot strap, connected to said outsole plate, and overlapping said upper for transmitting forces from said upper to said outsole plate and for providing additional foot support and preventing said upper from pulling away from said outsole plate during upstroke pedaling motion, said forefoot support strap being fixed at a first end to said upper on the side of said shoe opposite said for foot loop, and having a second end freely drawn across said upper, through said forefoot loop, and back across itself, said second end of said forefoot support strap being adjustably fastenable to said first end of said forefoot support strap; and a midfoot support strap attached to said shoe, connected to said outsole plate, and overlapping said upper for transmitting forces from said upper to said outsole plate and for providing additional foot support and preventing said upper from pulling away from said outsole plate during upstroke pedaling motion, said midfoot support strap being fixed at a first end to said upper on the side of said shoe opposite said midfoot loop and having a second end freely drawn across said upper, through said midfoot loop, and back across itself, said second end of said midfoot support strap being adjustably fastenable to said first end of said midfoot support strap.

10. A cleated cycling shoe comprising:

an upper;

an outsole plate permanently fixed to said upper, said outsole plate comprising a forefoot loop and a midfoot loop rigidly connected to said outsole plate;

means for detachably mounting and locating on said outsole plate cleats for detachably mounting said shoe on a bicycle pedal;

a forefoot support strap attached to said shoe and extending generally along and behind the line of metatarsal heads so that the natural flexing of the foot is not inhibited by said forefoot strap, connected to said outsole plate, and overlapping said upper for transmitting forces from said upper to said outsole plate and for providing additional foot support and preventing said upper from pulling away from said outsole plate during upstroke pedaling motion, said forefoot support strap extending across said upper from a side of said shoe opposite said forefoot loop, through said forefoot loop, and back across itself, said forefoot support strap being adjustably fastenable; and a midfoot support strap attached to said shoe, connected to said outsole plate, and overlapping said upper for transmitting forces from said upper to said outsole plate and for providing additional foot support and preventing the upper from pulling away from said outsole plate during upstroke pedaling motion, said midfoot support strap extending across said upper from a side of said shoe opposite said midfoot loop, through said midfoot loop, and back across itself, said midfoot support strap being adjustably fastenable.

11. A cleated cycling shoe as set forth in claim 7 or 8 wherein said forefoot and midfoot loops are integrally formed with said outsole.

12. A cleated cycling shoe as set forth in claim 7 or 9 wherein said loops are formed on the medial side of said outsole plate and said first end of said support straps are fixed to the lateral side of said upper.

13. A cleated cycling shoe as set forth in claim 12 wherein said forefoot loop is disposed behind and to the side of the first metatarsal head.

14. A cleated cycling shoe as set forth in claim 8 wherein said midfoot support strap extends generally across the instep of the foot.

15. A cleated cycling shoe as set forth in claim 13 wherein said forefoot loop and said midfoot loop are angled downwardly toward the front of said shoe to enable said forefoot and midfoot support straps to lay flat and prevent buckling of the said support straps.

16. A cleated cycling shoe as set forth in claim 7 or 9 wherein said second ends of said support straps are fastened to said first ends using hook and loop fasteners.

17. A cleated cycling shoe as set forth in claim 8 or 10 wherein said loops are formed on the medial side of said outsole plate.

18. A cleated cycling shoe as set forth in claim 8 or 10 wherein support straps are adjustably fastened with hook and loop fasteners.

19. A cleated bicycling shoe as set forth in claim 8 or 10 wherein said forefoot and midfoot loops are integrally formed with said outsole.

20. A cleated cycling shoe as set forth in claim 8 or 10 wherein said outsole plate is rigid.

21. A cleated cycling shoe comprising:

an upper:

a rigid outsole plate permanently fixed to said upper and having a forefoot loop and a midfoot loop rigidly connected to and integrally formed with the medial side of said outsole plate, said forefoot and midfoot loops being angled downwardly toward the front of said shoe and said forefoot loop being disposed slightly behind and to the side of the first metatarsal head;

means for detachably mounting and locating cleats to said outsole plate;

means for securing said upper around the foot of a wearer;

a forefoot support strap for transmitting forces produced at the first metatarsal head from said upper to said outsole plate and for providing additional foot support and preventing said upper from pulling apart from said outsole plate without impairing flexion or constricting the foot, said forefoot support strap being attached to said shoe and extending from the lateral side of said upper and generally along the line of metatarsal heads slightly behind the first metatarsal head, through said forefoot loop, back across itself, and adjustably fastened using hook and loop fasteners, said forefoot strap laying flat across said upper; and a midfoot support strap for transmitting forces from said upper to said outsole plate and for providing additional foot support and preventing said upper from pulling apart from said outsole plate without impairing flexion or constricting the foot, said midfoot support strap being attached to said shoe and extending from the lateral side of said upper and across the instep of the foot, through said midfoot loop, back across itself, and adjustably fastened using hook and loop fasteners, said midfoot strap laying flat across said upper.

* * * * *